United States Patent [19]

Missioux

[11] 4,132,094

[45] Jan. 2, 1979

[54] MACHINE FOR FORMING HELICOIDAL SPRINGS

[76] Inventor: Jean L. Missioux, 55 Boulevard Gambetta, 95110 Sannois, France

[21] Appl. No.: 813,982

[22] Filed: Jul. 8, 1977

[30] Foreign Application Priority Data

Jul. 9, 1976 [FR] France ..... 76 21097

[51] Int. Cl.[2] ..... B21F 3/04

[52] U.S. Cl. ..... 72/7; 72/22; 72/37; 72/138; 72/142

[58] Field of Search ..... 72/7, 8, 21, 22, 37, 72/135, 138, 140, 142, 143

[56] References Cited

U.S. PATENT DOCUMENTS

| | | | |
|---|---|---|---|
| 2,094,204 | 9/1937 | Carter et al. | 72/142 |
| 2,165,411 | 7/1939 | Peyton | 72/142 |
| 3,906,766 | 9/1975 | Sato | 72/138 X |

FOREIGN PATENT DOCUMENTS

| | | | |
|---|---|---|---|
| 1219058 | 1/1971 | United Kingdom | 72/143 |
| 1290805 | 9/1972 | United Kingdom | 72/142 |
| 458371 | 3/1975 | U.S.S.R. | 72/142 |

*Primary Examiner*—E. M. Combs

*Attorney, Agent, or Firm*—Cameron, Kerkam, Sutton, Stowell & Stowell

[57] ABSTRACT

The present invention relates to the manufacture of helicoidal springs in which there is associated with the mandrel for rolling of the spring a rotating cylinder carrying a helicoidal trace corresponding to the helix of the spring to be manufactured. A moving carriage which moves the mandrel longitudinally supports a scanner of the photoelectric cell type directed toward the rotating cylinder which controls the displacement of the movable carriage. Control devices supply a memory with the comparative values which provide for the future automatic control of the machine. The invention therefore relates to automatic machines to form helicoidal springs.

12 Claims, 3 Drawing Figures

MACHINE FOR FORMING HELICOIDAL SPRINGS

BACKGROUND OF THE INVENTION

The present invention relates to the manufacture of helicoidal springs and is concerned more exactly with a machine to form the springs and control apparatus for the machine.

Machines for winding springs comprise, as is known, a bar-mandrel for winding of the springs mounted in a rotatable broach which is mounted in a movable carriage for longitudinal displacement. The movable carriage is moved on a base and is driven by a rotating drive screw which by disconnectable means controls the movement of the carriage and consequently the pitch and number of turns of the spring. The precise type of the spring consequently depends upon the helicoidal groove of the drive screw used. If the manufacturer wishes to manufacture different types of springs a range of drive screws must be employed corresponding to the range of springs to be manufactured. This is a great inconvenience because of the difficulty in obtaining a drive screw provided with accurate grooves which is quite costly and on the other hand because of the shut-down time of the machine required for the replacement of the drive screw.

Another inconvenience of machines generally utilized is in the disconnectable means which connects the carriage to the drive screw which means generally are made up of a threaded nut closing on the drive screw which maneuver is often time consuming to carry out and inaccurate.

BRIEF SUMMARY OF THE INVENTION

The present invention provides a new machine for forming helicoidal springs which has none of the disadvantages discussed above and which has essentially the advantage of rapid adaptability without any complicated mechanical modification such as the replacement of the drive screw for providing a large variety of springs and permitting the use of a memory program of manufacturing values of the springs for repeating the manufacturing program.

In accordance with the present invention, a mandrel for rolling the spring is associated with a rotating cylinder carrying a helicoidal trace corresponding to the helix of the spring to be manufactured and the carriage for moving the mandrel longitudinally carries a scanner of the photoelectric cell type with its beam directed toward the rotating cylinder and including an electronic control system for the drive screw displacing the carriage longitudinally which reacts to the values furnished by the scanner.

In accordance with another characteristic of the present invention, control means are provided for the relative movements of rotation of the mandrel and of the drive screw for placing in a memory comparative values which result for automatic control of the machine.

BRIEF DESCRIPTION OF THE DRAWINGS

Other particular characteristics as well as advantages of the present invention will appear from the following description of a preferred embodiment thereof as shown in the accompanying drawings in which.

Figures 1, 2, 3:
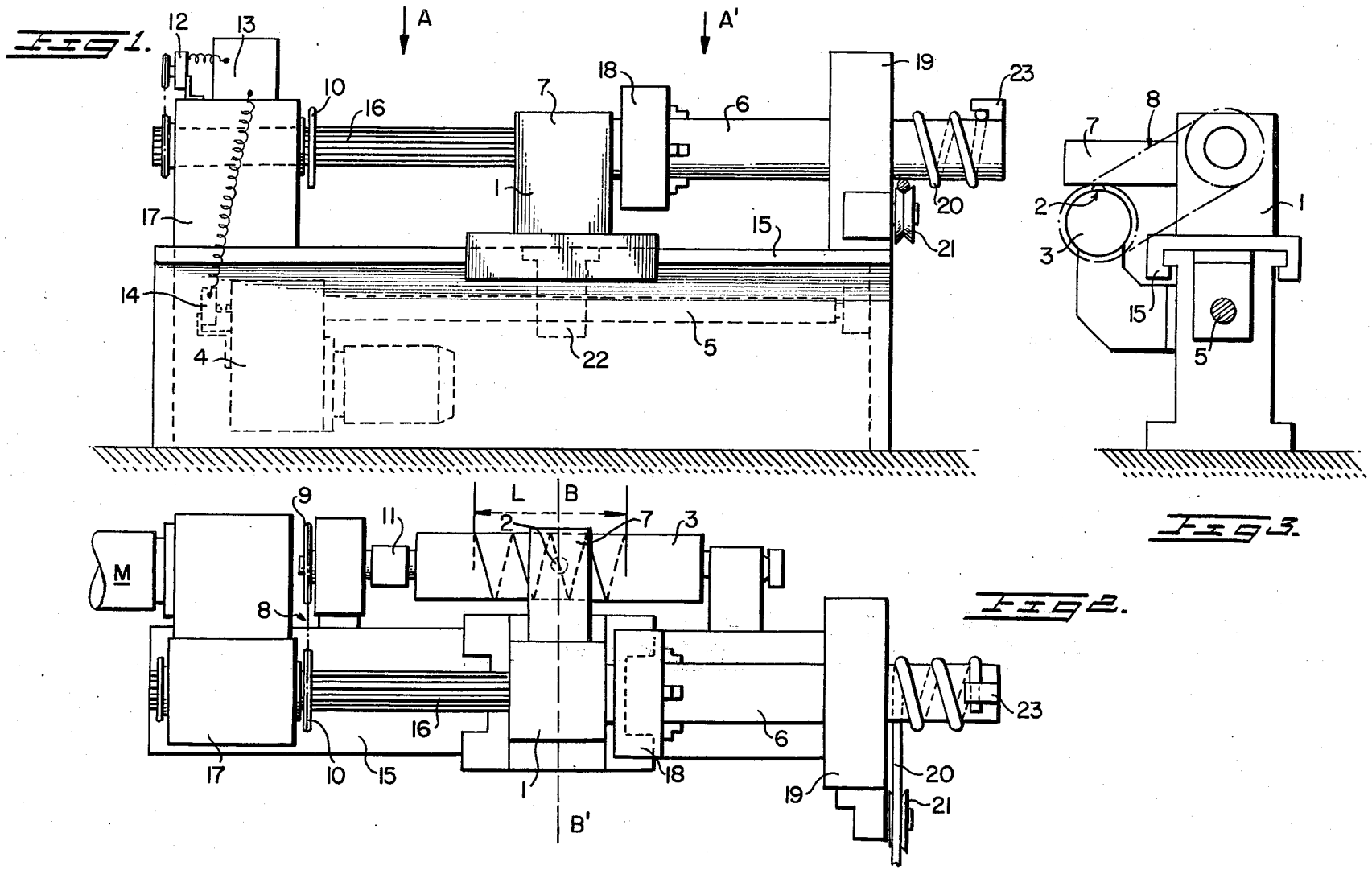
FIG. 1 is a longitudinal elevation of a preferred embodiment of the machine.
FIG. 2 is a view from above of the embodiment of FIG. 1 as seen in the direction of the arrows A and A'.
FIG. 3 is a vertical cross section of the embodiment of FIGS. 1 and 2 in the direction of the arrow BB' of FIG. 2.

The embodiment of the present invention as seen in FIGS. 1–3 comprises a fixed bench 15 on which a movable carriage 1 is displaced. A horizontal rotating broach 16 is mounted at one end in supporting block 17 mounted on the bench and passes through the upper part of carriage 1 and rotates a chuck 18 which carries a mandrel 6 on which the spring will be wound. Broach 16 is rotated by motor M (FIG. 2). Mandrel 6 is guided by a console 19 fixed to the other extremity of the bench 15. Wire 20 to be wound on the mandrel is guided by a pulley 21 adjustably mounted on console 19. The end of mandrel 6 carries a catch 23 for the end of the wire. Movable carriage 1 is driven longitudinally on bench 15 by a drive screw 5, the threads of which cooperate with a drive nut 22 located under the carriage. The drive screw is rotated by a motor 4.

On the side of the fixed bench is located a rotating cylinder 3 supported by arms and carrying a helicoidal trace corresponding to the helix of the spring to be manufactured. This trace has a length L identical to the length of the finished spring, the pitch of the trace and of the spring correspond being identical. This pitch is regular, uniformly increasing or uniformly decreasing in accordance with the pitch of the spring to be manufactured. Advantageously, the helicoidal trace is provided on a tube covering cylinder 3, or again it is prefabricated on a flat flexible plate which is then rolled on cylinder 3. To provide the trace on the tube or on the flexible plate, the trace can be engraved in depth or in relief or it can simply be imprinted thereon or the trace may be fixed thereon using a band or wire glued thereto or by other analogous means.

An extension 7 extends laterally from carriage 1 and mounts a scanner 2 which can be, for example, a photoelectric cell with rotating beam oriented in the direction of the rotating cylinder. The movement of rotation of cylinder 3 is connected to that of mandrel 6. A chain or transmission belt 8 connects to this end a drive pulley 9 to a pulley 10 mounted on broach 16 which drives mandrel 6.

The rotating cylinder 3 thus carries a helicoidal trace which is the image of the spring to be manufactured. To multiply the product possibilities, the rotating cylinder is removable and easily interchanged by reason of the coupling 11 between pulley 9 and the cylinder which permits rapid demounting. It should be noted further that the diameter of cylinder 3 is not necessarily that of the spring to be manufactured. The two are independent.

Drive motor 4 for drive screw 5 which moves carriage 1 longitudinally is controlled by the scanner 2, that is to say that carriage 1 follows exactly the trace carried by the rotating cylinder. An electronic system provides this control. To this end, a first impulse generator 12 is driven by rotating broach 16 of the rotating mandrel 6 by a belt or analogous transmission mounted on the extremity of the broach. The second impulse generator 14 is mounted on the driving device for the drive screw 5. The two generators 12 and 14 emit impulses which are received by an electronic control block 13 which electronic block compares the impulses and from this comparison provides a control of the movable carriage.

It will be noted that scanner 2 directs, through the electronic control system, the longitudinal movement of carriage 1 through the intermediate of the drive screw 5.

Electronic block 13 as well as generators of impulses 12 and 14 control proper functioning, that is the correct displacement of movable carriage 1 by the drive screw controlled through the scanner. The following Table contains information on the manner of control showing the functioning of control block 13.

| Rotation of Broach 16 | Impulses Provided By Generator 12 | Theoretical Rotation Of Drive Screw 5 | Actual Rotation Of Drive Screw 5 | Difference |
|---|---|---|---|---|
| 0 | 0 | 0 | 0 | 0 |
| 45° | 25 | 6 turns | 5 turns | −1 |
| 90° | 50 | 16 turns | 16 turns | 0 |
| 135° | 75 | 28 turns | 29 turns | +1 |
| 180° | 100 | 43 turns | 44 turns | +1 |

For example when mandrel 6 has gone through a rotation of 45°, impulse generator 12, associated with the movement of the mandrel, emits 25 pulses which are registered in block 13, then transformed in current intensity for the operation of motor 4. The drive screw then turns to displace movable carriage 1, the theoretical number of turns of the screw for 25 pulses being, for example, 6. Because of impulse generator 14, it can be verified that drive screw 5 has effectively been rotated six turns. In the present example only five turns have been accomplished. Generator 14 then emits toward block 13 impulses indicating a difference of one turn. Block 13 thus compares the impulses received from the generators 12 and 14 to control and automatically correct rotation of the drive screw and thus the displacement of the carriage.

Interchangeable programmable memories register the values provided by the control block 13 for the final control and repitition of a determined manufacturing cycle. The rotating cylinder 3 is then removed or made inoperative. This placing in memory of the corresponding program for a predetermined spring provides automatic control of the machine and avoids storage of cylinders or supports for the trace.

The present invention is not limited to the embodiment described above but includes all suitable modifications.

What I claim is:

1. A machine for making helicoidal springs heated or cooled comprising a rotating mandrel, around which a wire for forming a spring is wound, a motor rotating said mandrel, a movable carriage, a broach carried by said carriage and supporting said mandrel for longitudinal displacement of said mandrel, a drive screw engaging said carriage, a motor driving said drive screw, means for guiding the wire to be wound on said mandrel, a photoelectric scanner with a rotating beam mounted on a lateral extension of said movable carriage, a rotating cylinder, a helicoidal trace corresponding to the helix of the spring to be manufactured on said rotating cylinder, said scanner being above and oriented in the direction of said rotating cylinder, said mandrel being drivingly associated with said rotating cylinder, and said scanner controlling said motor driving said drive screw and thus controlling the longitudinal displacement of said carriage.

2. Machine as described in claim 1, said helicoidal trace on said rotating cylinder being regular in pitch and uniformly increasing and also uniformly decreasing following the pitch of the spring to be manufactured.

3. Machine as described in claim 1, the diameter of said rotating cylinder being independent of the diameter of the spring to be manufactured.

4. Machine as described in claim 1, including a hollow tube carrying said trace and covering said rotating cylinder.

5. Machine as described in claim 1 including a flat flexible plate mounting said trace and covering said rotating cylinder.

6. A machine as described in claim 4, said helicoidal trace being engraved on said tube.

7. A machine as described in claim 5, said helicoidal trace being engraved on said flat flexible plate.

8. A machine as described in claim 4, said trace being printed on said tube.

9. A machine as described in claim 5, said trace being printed on said flat flexible plate.

10. A machine as described in claim 4, said helicoidal trace being a band fixed on a said tube.

11. A machine as described in claim 5 wherein said trace is a band fixed on said flat flexible plate.

12. A machine as described in claim 1, including an independent coupling between said mandrel said cylinder whereby said cylinder may be rapidly removed and replaced.

* * * * *